United States Patent [19]

Lööf

[11] Patent Number: 4,488,361

[45] Date of Patent: Dec. 18, 1984

[54] METHOD FOR DRYING WOODEN PRODUCTS

[76] Inventor: Nils O. T. Lööf, S-547 01 Gullspång, Sweden

[21] Appl. No.: 395,046

[22] PCT Filed: Oct. 15, 1981

[86] PCT No.: PCT/SE81/00303

§ 371 Date: May 26, 1982

§ 102(e) Date: May 26, 1982

[87] PCT Pub. No.: WO82/01411

PCT Pub. Date: Apr. 29, 1982

[30] Foreign Application Priority Data

Oct. 15, 1980 [SE] Sweden ..... 8007239

[51] Int. Cl.[3] ..... F26B 3/34

[52] U.S. Cl. ..... 34/1; 34/50; 34/68; 219/10.55 M; 219/10.55 R

[58] Field of Search ..... 34/1, 50, 46, 68; 219/10.55 R, 10.55 M

[56] References Cited

U.S. PATENT DOCUMENTS

| | | | |
|---|---|---|---|
| 3,409,447 | 11/1968 | Jeppson | 34/1 |
| 3,721,013 | 3/1973 | Miller | 34/1 |
| 3,775,860 | 12/1973 | Barnes et al. | 34/1 |

FOREIGN PATENT DOCUMENTS 1053012 12/1966 United Kingdom .

*Primary Examiner*—Larry I. Schwartz

*Attorney, Agent, or Firm*—Sughrue, Mion, Zinn, Macpeak & Seas

[57] ABSTRACT

The invention relates to a method for drying wooden products and solves the problem of providing such a method which is very economical and allows continuous control of the drying process. According to the invention the products are the moisture to migrate to the external surfaces of the products where it is absorbed by the air which is then dehumidified. The temperature and moisture content of the chamber atmosphere are continuously controlled.

7 Claims, No Drawings

METHOD FOR DRYING WOODEN PRODUCTS

BACKGROUND OF THE INVENTION

The oldest and still dominating method for drying timber and other wooden products is to place the products in a chamber through which heated air does continuously pass. The warm air flows past the external surfaces of the products and absorbs therefrom moisture which then leaves the chamber together with the air. Accordingly, that method can be defined as a continuous process in an open circuit. It suffers from several disadvantages and limitations, the most important of which are the following ones.

The wooden products are dried by heat conduction in the way that the surface layer is first dried. The drying process does then, at a gradually lower rate, proceed towards the center of each product. This is disadvantageous for several reasons. The drying occurs very slowly, primarily because wood is a very bad heat conductor. In addition thereto, the slow removal of moisture is accentuated by the direction of the moisture gradient. The reason for this is that the drying of the surface layers results in a shrinking, a reduction of the distance between the wood fibres and, hence, in a corresponding restriction of the passages through which the moisture can migrate outwards. This effect is differently pronounced in different sorts of wood and, in many cases, it is accompanied by cracking in the surface layers. For that reason some sorts of wood cannot at all be dried by forced air circulation; instead they require that the drying takes place during a very extended period of time, in extreme cases several years. Due to the fact that the drying occurs in a completely open system the content of excess heat in the air leaving the chamber cannot be used or, stated in other words, the efficiency of the method is very low.

In an effort to avoid that the drying will start at the external surface and then progress inwardly and require long time there has, during the latest years, also been applied another method. According to that method the article to be dried is placed between a pair of electrodes connected to a high-frequency generator. As is well-known, disregarding the edge effects which in this context are completely negligible, the useful electrical field is only present in the space between the electrodes. This means that, for practical and economical reasons, the usefulness of that method is limited to articles the shapes of which are suitable for high-frequency drying and the dimensions of which are relatively small. A third condition is that the articles must be manufactured in long series. This applies to e.g. components used in the furniture industry. Another factual circumstance, also limiting the usefulness of that prior art method, is the low capacity of wood to absorb HF energy. This often results in electrical flash-overs caused by the high electrode voltage necessary. A still further requirement implies that practically no variations in the cross-sectional area of the products can be permitted since, otherwise, they are not dried homogenously and subject to damages by cracking and the like. Accordingly, it is difficult to control such a drying process and it is obvious that it cannot be used for drying logs and the like.

SUMMARY OF THE INVENTION

The object of the present invention is to provide a method for drying wooden products which shall not suffer from the above-mentioned disadvantages and limitations. The invention is based on the following realizations.

In order to satisfy the requirement for economy it is necessary to abandon the continuous process in favour of a discontinuous one carried out inside a closed chamber. Second, in order to shorten the duration of the process, the direction of the drying must not be from the external surfaces of the products to their centers but opposite, so that the moisture is forced to migrate from the centers to the surface layers. Third, the heat shall be supplied via electromagnetic waves but, in contrast to the prior art high-frequency (HF) method, the effect of the electromagnetic energy shall not be restricted to a comparatively small space between a pair of electrodes but useful within a much bigger volume, more particularly inside all of a drying chamber.

Another object of the invention is to provide a drying method which may conveniently be controlled. The latter requirement is twofold. One requirement is for good control during the drying of a given batch of products. Another requirement is that the method shall render itself for flexible matching to different types of products, especially as far as differences in respect of wood sorts, moisture content and dimensions are concerned. More specifically, the latest requirement involves that it shall be possible, by programming the equipment governing the drying process, in each individual case to satisfy all conditions for optimized drying.

The above-mentioned and other objects and advantages are achieved by a method according to the present invention the detailed characteristic of which appear from the claims. However, the basic inventive concept is based on the following realization. By use of microwave energy instead of HF energy it is possible to generate electromagnetic fields inside all of a drying chamber. By control of the humidity and temperature of the air inside the chamber it is possible to govern the drying of wooden products inside the chamber in such a way that the surface layers of the products are prevented from being dried first which may cause cracking and other disadvantageous effects as above explained. It is also a main characteristic of the invention that the chamber is closed and that the air inside it is recirculated. This does very significantly improve the economy of the process because, as a matter of principle, no heat is lost to the surrounding atmosphere. As will be explained below, the only input to the chamber is electrical microwave energy and the only output is water absorbed from the products by the air inside the chamber and then removed therefrom.

DETAILED DESCRIPTION OF THE INVENTION

The method according to the invention will now be described in greater detail.

As has already been mentioned, the wooden products to be dried are placed inside a closed chamber. In the interior of the chamber there are generated microwave energy fields produced by one or more generators mounted outside the chamber and connected to waveguides opening into the chamber. It should be underlined here that the number of generators, i.e. primarily the total power, is in each case chosen with regard to the actual circumstances, above all the volume of the chamber and the operating frequency of the generators. Thus, in some cases it could be both sufficient and most suitable to have one generator only, for instance a magnetron, whereas in other cases several generators are used. In the latter case the generators may operate on mutually different frequencies, protection against disturbing interactions being provided for by filters according to principles well-known in the art. As far as the selection of the magnetron frequencies is concerned a first consideration is that they must fall within the so-called ISM bands, the only ones permitted for industrial purposes. Selection of the exact frequencies inside those bands is then governed by actual operational parameters, including especially the chamber volume, the dimensions of the wooden products, the sort of tree and the moisture content. Therefore, when the invention is worked in practice, the frequency selection is generally a compromise between different considerations which may point in different directions. However, in order to prevent the wooden material from drying up, crack and get clogged before the water contained therein has been expelled, it is necessary that the heat-generation be concentrated to the water and not to the wood. This means that the frequency must not be close to the HF range, as in that case the dominant energy absorption will be caused by the resistive losses in the wood which are relatively independent of its moisture content. On the other hand, use of too high a frequency limits the penetration depth because one will then approach the dipole relaxation frequency of water (around 20 GHz). For practical purposes the upper frequency limit is generally around 10 GHz.

In this connection it could be mentioned that, in addition to water, the wood does also contain lignin, resin and other substances comprising OH radicals. With a proper frequency selection the dominating heat generation will be in the water and the second greatest in the substances just mentioned, whereas the heat amount absorbed in the wood will be insignificant.

The positive result of the fact that the water will absorb the majority of the microwave energy supplied is not only that the wood itself will be heated very insignificantly but also that the heated water will tend to migrate towards the external surface of the product and that, due to the relatively low temperature of the wood, its "pores" or "capillaries" will be kept open so that the water may pass. As is understood, this condition is in sharp contrast to what applies in prior art methods where the heating occurs in the opposite direction, by conduction from the external surface of the product towards its center, meaning that the migration passages originally existing in the humid material will be contracted. This is the reason why, according to the prior art methods, it is necessary to accept either a very time-consuming drying process or wood cell bursting in the surface layer material. Such bursting often immediately results in cracks and flaws but it does also frequently happen that the result is a build-up of internal tensions which do not damage the material until the product is to be machined long after the termination of the drying process. While also according to the present invention the humidity in the external layers will first leave the products, for the reason just mentioned this will result in a reduced heat generation in those layers so that the total heat absorption there will be less than in the central portions. Since wood is a bad heat-conductor, practically no heat equalization due to conduction will occur or, stated otherwise, there will successively build up a higher temperature in the central portions of the products.

It has been explained above that, in order to achieve that the drying of the products will start in their central regions and successively move to the outer layers, in contrast to the prior art methods where the heat is by conduction transported from the external layers to the central portions, it is necessary to control the process so that the conversion of the electromagnetic energy to heat energy be concentrated to the water in the material. However, such a control is not sufficient to realize the technical advantages of the invention. More particularly, two further conditions must be satisfied, both relating to the "climate" inside the chamber. One of those conditions relates to the humidity and the other to the temperature of the air in the chamber.

Therefore, it is a characteristic feature of the invention that, during the initial stage of the drying process, the moisture content of the air is kept high so that the surface layers of the products are not dried by delivery of moisture to the ambient air. In order to achieve this it may be necessary during the initial stage to raise the relative humidity of the air by introducing water in atomized form.

As far as the temperature of the chamber air is concerned it should be pointed out that, in contrast to what applies according to conventional methods, the temperature of the air should always be lower than the temperature inside the products. In this way the products cannot receive heat from the air which, as explained above, would result in conditions counteracting the desired moisture migration in the outward direction. When microwave energy is absorbed by the water and by the other substances making up the wooden material, the air temperature will of course rise but it should always be maintained at a lower value than the surface temperature of the products. The major importance of this difference relatively the prior art, where the air temperature is instead somewhat higher than the surface temperature of the products, is not the prevention of a certain drying of the surface layers under the influence of the air. Instead the decisive factor is that the lower air temperature contributes to the maintenance of a temperature gradient inside the products directed opposite that prevailing according to the prior art, whereby the moisture migration is facilitated.

To the extent practical it is suitable to create homogenous conditions in the chamber both as far as the temperature and the humidity content of the air is concerned and in respect of the heat absorption inside the products. Homogenous air conditions can be obtained by means of fans circulating the air in the chamber and, especially, effectively distributing atomized water supplied during the initial stage. Such fans may also perform a second function, namely circulate the chamber air through a special space housing a condenser on which the moisture in the air is condensed, whereupon the air is fed back to the drying chamber proper. The partition between the chamber and the dehumidifying space suitably consists of a sheet of perforated aluminum, the openings of which are dimensioned so that the wall becomes impermeable to microwave energy whereas air can freely flow therethrough.

In some applications one could also rely on metal propellers which improve the distribution of the microwave energy. The number of such propellers and their locations is to be determined in each individual case taking into consideration inter alia the number of magnetrons, the shape of the waveguides etcetera. In order still further to enhance a homogenous microwave energy absorption by the products one can place the latter on a table rotating slowly so that no shadow effects will arise.

The use of fans and the air circulation caused by the fans differ in two essential respects from the prior art. These differences do both stem from the fact that the method according to the present invention is carried out discontinuously in a closed chamber whereas conventional warm air drying is carried out continuously in an open system. The one difference concerns the power consumption of the fans. As they are not used for the purpose of continuously changing the air in the chamber but only in order to perform a "stirring" action in one and the same air volume for the purpose of homogenizing the air as far as its temperature and humidity content is concerned, the power consumption of the fans will amount to a fraction only of that required in conventional installations. The second difference, that the air is recirculated, whereby the major portion of its heat energy content is preserved, does also result in a most substantial improvement of the economy of the method.

Further advantages are achieved when, according to a preferred embodiment of the invention mentioned above, the air is dehumidified in a separate space which from a microwave point of view is insulated from the chamber housing the wooden products but in communication therewith as far as the air flow is concerned. One such advantage is elimination of the difficulty of mounting conventional temperature and humidity signal transmitters in places where they are subjected to microwave energy. However, there is no problem at all in installing such transmitters inside the separate space housing the condenser. On the other hand, one should try to mount them at a maximum distance from the condenser whereby the transmitted signals will be representative of the conditions in the drying chamber. Generally, it is possible just to carry out a few experiments in order to determine the relevant corrections and then correspondingly to calibrate the instrument equipment. The signals supplied by the transmitters form a direct basis for the air and humidity control. However, they may also indirectly supply an empirical information which can be relied upon for variation of the supplied microwave energy during the course of a drying process. One reason why such a variation may be needed is the following one. As the humidity content of the products decreases, there are inside the products formed dried cavities which may generate multiresonance cavity effects tending to increase the field intensity inside the material. If the wooden material is not homogenous, for example due to the presence of local areas having a high resin content, the heating may be inhomogenous. However, by successively decreasing the microwave power input it is possible to compensate for that effect so that the field intensity can all the time be kept at an optimal level.

It has above been repeatedly underlined that, when the method according to the invention is carried out in practice, one has to take into account a plurality of basic input parameters, the geometry of the chamber, the power of the magnetrons, their operating frequencies, number and locations as well as the sort of wood, the moisture content and the shapes of the products. This means that it is impossible to give working instructions in the form of absolute numbers. Instead, during an introductional stage, it will as a rule be necessary by experiments to determine which operational parameters correspond to the input parameters. Therefore, the invention is utilized in any instance where wooden products are heated by microwave energy inside a closed chamber the atmosphere of which is controlled in such a way that the drying occurs by a moisture migration as above described. On the other hand, when some experiments have been carried out and the optimal operational values for different products have been established, it is possible to compile programs which, when a certain process is to be repeated, can be used for automatically controlling it. As appears from what has been said above, such programs will generally differ substantially from each other, above all programs relating to different sorts of wood.

I claim:

1. A method for drying wooden products, comprising the steps of: discontinuously introducing a batch of said wooden products into a closed chamber, the walls of which are impermeable to microwave energy; generating inside the chamber electrical microwave energy fields throughout said chamber completely surrounding said wooden products, continuously recirculating the same air within said chamber; and controlling the temperature and moisture content of the recirculated air in the chamber, by initially keeping the moisture content at a high level and reducing it when, in response to heat generation inside the products caused by the microwave energy, migration of moisture from the interior of the products towards their external surfaces has been initiated, and by keeping the air temperature at a value slightly below the temperature of said surface, and allowing it successively to rise in pace with the rising of the surface temperature, and removing from the air the moisture it has received from the products.

2. A method as claimed in claim 1, characterized in that the air is, in a manner known per se, dehumidified by being brought into contact with a condenser.

3. A method as claimed in claims 1 or 2, characterized in dehumidifying the air in a space separated from the chamber by a partition, e.g. a perforated metal wall, which permits air flow communication but insulates the space from microwave energy.

4. A method as claimed in claims 1 or 2, characterized in that, during the initial portion of the drying process, water in atomized form is introduced into the chamber in order then to maintain a high moisture content therein.

5. A method as claimed in claim 1, characterized in that the microwave energy power input is controlled during the prosecution of the drying process.

6. A method as claimed in claim 1, characterized by the use of a plurality of microwave generators for feeding microwave energy into the chamber.

7. A method as claimed in claim 6, characterized by the use of microwave generators operating at frequencies significantly spaced from one another.

* * * * *